United States Patent [19]

Iguchi et al.

[11] 4,436,805

[45] Mar. 13, 1984

[54] SILVER COMPLEX DIFFUSION TRANSFER PROCESS USING TWO TONING AGENTS

[75] Inventors: Shigeru Iguchi; Seigo Ebato, both of Nagaokakyo, Japan

[73] Assignee: Mitsubishi Paper Mills, Ltd., Tokyo, Japan

[21] Appl. No.: 423,723

[22] Filed: Sep. 27, 1982

[30] Foreign Application Priority Data

Oct. 26, 1981 [JP] Japan ..... 56-171138

[51] Int. Cl.[3] ..... G03C 5/54; G03C 1/10; G03C 1/40

[52] U.S. Cl. ..... 430/248; 430/233; 430/370; 430/965

[58] Field of Search ..... 430/233, 248, 251, 370, 430/965

[56] References Cited

U.S. PATENT DOCUMENTS

| | | | |
|---|---|---|---|
| 3,307,944 | 3/1967 | Weyde et al. | 430/233 |
| 3,431,108 | 3/1969 | Willems et al. | 430/233 |
| 3,619,186 | 11/1971 | Parsons | 430/233 |
| 3,698,900 | 10/1972 | Johnson | 430/233 |
| 3,702,246 | 11/1972 | Ohyama et al. | 430/233 |
| 4,298,673 | 11/1981 | Kuboteta | 430/248 |

*Primary Examiner*—Richard L. Schilling

*Attorney, Agent, or Firm*—Cushman, Darby & Cushman

[57] ABSTRACT

Disclosed are a developer for silver complex diffusion transfer process which contains a nitrogen-containing heterocyclic compound having a mercapto or thione group and, as substituent, an alkyl group of 4 or more carbon atoms, an aryl group, or a group having both the alkyl and aryl groups and further contains an alkali-soluble iodide in an amount such that the molar ratio of the iodide in terms of iodine to the heterocyclic compound is in the range of from 1:5 to 5:1 and a silver complex diffusion transfer process using said developer, according to which transferred silver images of improved color tone, maximum density, contrast and sharpness can be obtained.

8 Claims, No Drawings

SILVER COMPLEX DIFFUSION TRANSFER PROCESS USING TWO TONING AGENTS

BACKGROUND OF THE INVENTION

This invention relates to a silver complex diffusion transfer process (DTR process) and more particularly, to a developer used in the process.

In the DTR process, the silver complex is imagewise transferred by diffusion from the silver halide emulsion layer to an image receptive layer where the silver complex is converted into a silver image mostly in the presence of physical development nuclei. For this purpose, layers are so disposed that the imagewise exposed silver halide emulsion layer may be in contact with the image receptive layer in the presence of a developing agent and a silver halide complexing agent, or, alternatively, such contact is established after exposure by bringing the former layer into contact with the latter layer, whereby the unexposed silver halide is converted into soluble silver complex. The silver halide in the exposed areas of silver halide emulsion layer is developed to metallic silver (chemical development) which is insoluble and non-diffusing. The silver halide in the unexposed areas is converted into soluble silver complex which is transferred to the image receptive layer and forms a silver image generally in the presence of development nuclei.

In the DTR process for the reproduction of documents or the preparation of block copy materials, it is important to form in the image receptive layer a silver image of high maximum density, high contrast and high sharpness. It is generally known that in order to obtain a transferred silver image of such quality, the speed of diffusion transfer development should be increased. Further, in the DTR process for the above purpose, it is also important that the developed silver image in the receptive layer be pure black or bluish black in color. It is known that to obtain such a transferred silver image, a so-called image toning agent (toner) should be added to the image receptive layer or during the diffusion transfer development.

Among various known toners, useful ones are nitrogen-containing heterocyclic compounds having a mercapto or thione group, particularly those which have a mercapto or thione group and, in addition, an alkyl group of 4 or more carbon atoms, or an aryl group, or a group in which both the alkyl and aryl groups are present (e.g. an aralkyl group). As a typical example of such compounds, mention may be made of 1-phenyl-5-mercaptotetrazole. Such a nitrogen-containing heterocyclic compound, however, has a disadvantage of markedly reducing the transfer development speed, though it acts as a toner superior to those nitrogen-containing heterocyclic compounds having no substituent or having as substituent a lower alkyl group or/and a group involving no carbon atoms (e.g. a halogen atom, hydroxyl group, and amino group). Because of its repressive effect on the speed of development, the nitrogen-containing heterocyclic compound is subject to restriction with respect to its concentration in the developer, resulting in not only insufficient tone improvement but also a silver image unsatisfactory in the levels of maximum density, contrast and sharpness, the improvement of which is achieved by high speed transfer development.

SUMMARY OF THE INVENTION

An object of this invention is to provide a silver complex diffusion transfer process which is capable of producing a transferred silver image more improved in tone, maximum density, contrast and sharpness.

Another object of this invention is to provide a developer for silver complex diffusion transfer process which produces a transferred silver image more improved in tone and photographic characteristics.

DESCRIPTION OF THE INVENTION AND PREFERRED EMBODIMENTS

The present invention is based on the discovery that the above objects are achieved by the use of a silver complex diffusion transfer developer containing an alkali-soluble iodide and at least one nitrogen-containing heterocyclic compound having a mercapto or thione group and an alkyl group of 4 or more carbon atoms, an aryl group, or a group containing both the alkyl and aryl groups as substituents.

As is well known to those skilled in the art, when the concentration of the above-said nitrogen-containing heterocyclic compound in the developer is increased to a certain value, there appears a rapid decline in the speed of transfer development, resulting in a silver image of insufficient maximum density, said value being dependent upon the formulation of the developer and the type of photosentitive element or image receptive element. A iodide soluble in an alkaline developer such as, for example, potassium idodide also decreases the speed of transfer development, resulting in generally a silver image of insufficient maximum density. It was unexpectedly found, however, that by the use of a developer containing a combination of the nitrogen-containing heterocyclic compound and the alkali-soluble iodide, it is possible to obtain a silver image of a higher maximum density and of an improved tone as compared with the silver image obtained by use of either of said compounds alone. A suitable molar ratio of both compounds is in the range of from 1:5 to 5:1, preferably from 1:3 to 3:1, most preferably about 1:1, the iodide being expressed in terms of iodine.

The nitrogen-containing heterocyclic compound having a mercapto or thione group, which is used in the present developer, is represented, for example, by the following general formula (I) or (II):

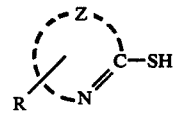

(I)

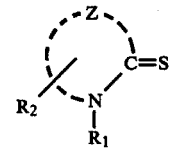

(II)

wherein R represents an alkyl group of 4 or more carbon atoms, an aryl group, or a substituent group containing both the alkyl and aryl groups; $R_1$ and $R_2$ may be each a hydrogen atom or any substituent but at least one of $R_1$ and $R_2$ represents an alkyl group of 4 or more carbon atoms, an aryl group, or a substituent group containing both the alkyl and aryl groups; R or $R_2$ may be plural and may contain other substituents than those defined above; and Z is a known 5- or 6-membered heterocyclic ring such as, for example, triazole, tetrazole, oxadiazole, thiadiazole, imidazole, imidazoline, imidazolidine, thiazol, thiazoline, thiazolidine, oxazole, oxazoline, oxazolidine, benzimidazole, benzothiazole, benzaoxazole, tetrazaindene, triazine, or pyrimidine. Suitable alkyl groups of 4 or more carbon atoms are those of 4 to 12, especially 5 to 10, carbon atoms. A desirable result is obtained by using the compounds represented by the general formula (I), especially those having an aryl group.

The examples of compounds having a mercapto or thione group, suitable for use in the present developer, are as shown below:

(1)

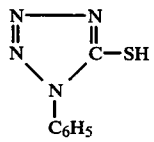

(2)

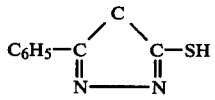

(3)

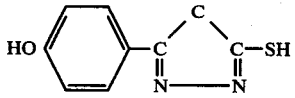

(4)

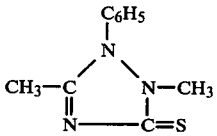

(5)

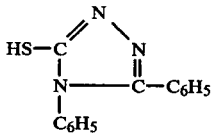

(6)

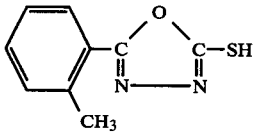

(7)

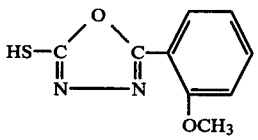

(8)

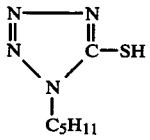

(9)

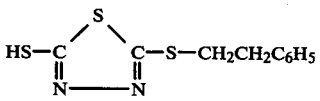

-continued (10)

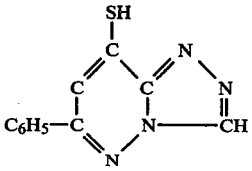

(11)

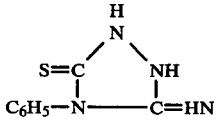

(12)

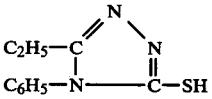

(13)

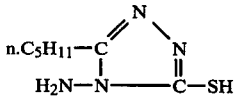

(14)

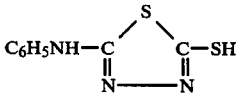

(15)

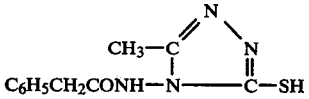

(16)

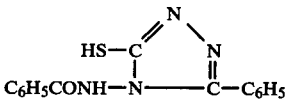

(17)

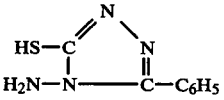

(18)

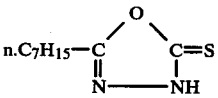

(19)

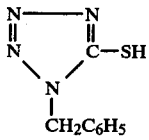

(20)

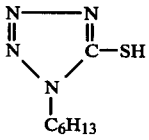

(21)

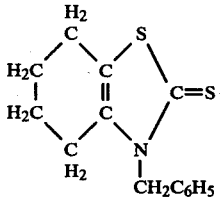

-continued (22)

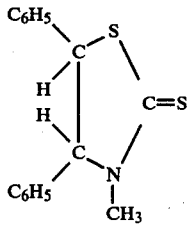

(23)

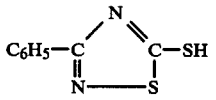

(24)

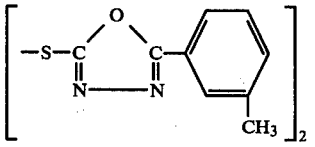

The above nitrogen-containing heterocyclic compound is used in an amount of 0.001 to 3.0, preferably 0.005 to 3.0, millimoles per liter of the diffusion transfer developer.

The alkali-soluble iodides for use in the present developer include water-soluble iodides of potassium, sodium, lithium, ammonium, and strontium. Unless objectionable, organic iodides may also be used. The alkali-soluble iodide is used in an amount of 0.001 to 3.0, preferably 0.005 to 3.0, millimoles in terms of iodine per liter of the diffusion transfer developer.

The most desirable result is obtained when the total amount of both compounds is 0.01 to 1.5 millimoles and the molar ratio of both compounds is in the range of from 1:3 to 3:1.

The present developer for use in DTR process may contain alkaline substances, e.g. sodium hydroxide, potassium hydroxide, lithium hydroxide, and trisodium phosphate; preservatives, e.g. sulfites such as sodium sulfite, etc.; thickeners, e.g. carboxymethylcellulose and hydroxyethylcellulose; antifoggants, e.g. potassium bromide; solvents for silver halides, e.g. thiosulfates such as sodium thiosulfate etc., thiocyanates such as potassium thiocyanate, etc., cyclic imide compounds, etc.; development modifiers, e.g. amine compounds and polyoxyalkylene compounds; development nuclei, e.g. those described in Brit. Pat. No. 1,001,558; and, if necessary, developing agents, e.g. hydroquinone and 1-phenyl-3-pyrazolidone, toners, etc.

The pH of the developer is adjusted to a value suitable for activating the developing agent, that is, generally 10 to 14, preferably about 12 to 14. The maximum pH value in particular cases of the DTR process depends upon the photographic element employed, intended image, type and quantity of various compounds used in the developer composition, and the treating conditions.

In one of the examples of preferred embodiments of the present invention, the developer contains at least one alkaline reagent, a silver halide solvent, and a secondary or tertiary aminoalcohol having as substituent an alkyl group of 1 to 4 carbon atoms and pH is adjusted to about 12 to 14.

The negative element used in the DTR process according to this invention comprises an unfogged silver halide emulsion layer containing 80, preferably 90, mole-% or more of silver halide.

Although useful for forming a transparency image on an image receptive material in which a transparent film support is used, the present developer is more advantageously used in forming a reflex image on an image receptive material in which an opaque support is used. The processing conditions such as duration and temperature of treatments are not specifically limited but may be suitably selected in accordance with various factors such as, for example, the type of ingredients of the photographic element and developer composition.

In carrying out the DTR process, it is a general practice to incorporate a developing agent in a photosensitive silver halide emulsion layer and/or an image receptive layer, or other water-permeable colloid layers adjacent to said layers, as described, for example, in Brit. Pat. Nos. 1,000,115, 1,012,476 and 1,093,177. Accordingly, the processing solution used in the development stage can be a so-called alkaline activator solution containing no developing agent. The present developer composition may be preferably such an alkaline activator processing solution. The present developer composition may contain, in addition to the various compounds mentioned above, other additives generally used in DTR processing solutions.

The negative material generally used in the DTR process is composed of at least one silver halide emulsion layer coated on a support at a coverage of 0.5 to 3.5 g in terms of silver nitrate per square meter. If necessary, auxiliary layers such as an undercoat layer, intermediate layer, protective layer, and strippable layer are provided in addition to the silver halide elumision layer. For instance, in the negative material used in this invention, in order to improve the uniformity of transfer, the silver halide emulsion layer can be overcoated with a layer of water-permeable binder described in Japanese Patent Publication Nos. 18,134/63 and 18,135/63, such as, for example, methylcellulose, carboxymethylcellulose sodium salt, or sodium alginate, said overcoating layer being thin enough substantially not to hinder or retard the diffusion.

The silver halide emulsion layer in a negative material and the image receptive layer in a positive material contain one or more highly polymerized hydrophilic colloidal substances such as gelatin, gelatin derivatives, e.g. phthalated gelatin; cellulose derivatives, e.g. carboxymethylcellulose and hydroxyethylcellulose; dextrin, soluble starch, polyvinyl alcohol, and polystyrenesulfonic acid. The silver halide emulsion comprises the above hydrophilic colloid and, dispersed therein, silver halides, e.g. silver chloride, silver chlorobromide, or a combination of these silver halides with silver iodide. The silver halide emulsion can be sensitized in various ways during its manufacture or before coating. The chemical sensitization is performed by means of sodium thiosulfate, an alkylthiourea, or gold compounds, e.g. gold rhodanide and gold chloride, or in other ways well known to those skilled in the art. The emulsion can also be spectrally sensitized generally to about 530 to about 560 nm or panchromatically. The silver halide emulsion layer and/or the image receptive layer may contain any of the compounds commonly used in carrying out the silver complex diffusion transfer process. Such compounds include antifoggants, e.g. tetrazaindene and mercapto compounds; coating aids, e.g. saponin and polyalkylene oxides; hardeners, e.g. formalin and chrome alum; and plasticizers.

The supports for use in the negative material or image-receptive material are those commonly used in photographic materials, such as paper, glass, films, e.g. cellulose acetate film, polyvinyl acetal film, polystyrene film, and polyethylene terephthalate film; metal supports covered on both sides with paper; and paper supports coated on one or both sides with an α-olefin polymer, e.g. polyethylene.

The image receptive material may contain physical development nuclei, e.g. heavy metals or sulfides thereof. One or more layers of an image receptive material may contain substances which play an important part in the formation of diffusion transfer image, such as toners of this invention or other toners. Desirable results are obtained when an image receptive material containing the toner of this invention is used. The developing agent may be incorporated in such image receptive material as described in Japanese Patent Publication No. 27,568/64.

The invention is illustrated below in detail with reference to Examples, but the invention is not limited thereto.

EXAMPLE 1

A positive material was prepared by providing one side of a transparent film base with an image receptive layer comprising palladium sulfide nuclei and a binder produced from polyvinyl alcohol and an ethylene-maleic anhydride copolymer, the coverage of said layer having been 3 g/m$^2$ on dry basis.

A negative material was prepared by providing a polyethylene-coated paper support with a gelatin undercoat containing carbon black, 1-phenyl-4-methyl-3-pyrazolidone, and hydroquinone and overcoating with an orthochromatically sensitized silver halide emulsion layer containing silver chlorobromide (3 mole-% of silver bromide), 0.3μ in average grain size, at a coverage of 1.5 g/m$^2$ in terms of silver nitrate.

The negative material which was imagewise exposed and the positive material thus prepared were treated in a common processor with the following diffusion transfer developer admixed with varied amount of a toner and an iodide as shown in Table 1. Sixty seconds after delivery from squeeze rollers, both materials were pulled apart. The processing temperature was 20° C.

| Transfer developer: | |
|---|---|
| Water | 700 ml |
| Trisodium phosphate, dodecahydrate | 75 g |
| Sodium sulfite, anhydrous | 40 g |
| Potassium hydroxide | 10 g |
| Sodium thiosulfate, penta hydrate | 20 g |
| Potassium bromide | 1.0 g |
| Methylaminoethanol | 20 ml |
| Made up with water to | 1 liter |

The transmission densities obtained with a series of developers were as shown in Table 1.

TABLE 1

| Developer No. | Compound (1) (× $10^{-1}$ mmol/liter) | KI (× $10^{-1}$ mmmol/liter) | Transmission density |
|---|---|---|---|
| 1 | 0 | 0 | 3.18 |
| 2 | 1 | 0 | 3.10 |
| 3 | 2 | 0 | 2.97 |
| 4 | 4 | 0 | 2.75 |
| 5 | 8 | 0 | 2.24 |
| 6 | 0 | 1 | 3.14 |

TABLE 1-continued

| Developer No. | Compound (1) (× $10^{-1}$ mmol/liter) | KI (× $10^{-1}$ mmmol/liter) | Transmission density |
|---|---|---|---|
| 7 | 0 | 2 | 3.06 |
| 8 | 0 | 4 | 2.95 |
| 9 | 0 | 8 | 2.78 |
| 10 | 1 | 1 | 3.17 |
| 11 | 2 | 2 | 3.11 |
| 12 | 4 | 4 | 3.02 |
| 13 | 2 | 4 | 3.04 |
| 14 | 4 | 2 | 3.00 |

It is seen from Table 1 that although slightly lower than the value obtained with developer No. 1, the transmission densities obtained with developer Nos. 10 to 14 are appreciably higher than those obtained with reference developers Nos. 2 to 9, indicating that according to this invention it is possible to increase the amount of toner, resulting in a more improved black silver image.

EXAMPLE 2

A positive material was prepared in the same manner as in Example 1, except that a polyethylene-coated paper support was used in place of the transparent film base. The test results were obtained in otherwise the same manner as in Example 1 and were as shown in Table 2.

TABLE 2

| Developer No. | Compound (1) (× $10^{-1}$ mmol/liter) | KI (× $10^{-1}$ mmol/liter) | Reflection density |
|---|---|---|---|
| 15 | 0 | 0 | 1.36 |
| 16 | 3 | 0 | 1.41 |
| 17 | 6 | 0 | 1.32 |
| 18 | 0 | 3 | 1.42 |
| 19 | 0 | 6 | 1.44 |
| 20 | 1.5 | 1.5 | 1.47 |
| 21 | 3 | 3 | 1.54 |
| 22 | 6 | 6 | 1.59 |
| 23 | 3 | 6 | 1.50 |

The reflection density obtained with reference developer No. 15 was 1.45 when both materials were pulled apart 15 seconds after the delivery from the squeeze rollers. Therefore, the reflection density 1.36 with reference developer No. 15 shown in Table 2 indicated that a metallic luster was produced as the result of predominance of silver deposition on the surface of positive material owing to the high transfer speed in this case. As compared with developer No. 15, higher reflection densities were obtained with reference developers Nos. 16, 18 and 19 because of retarded tranfer speed. The present developers Nos. 20 to 23 produced higher reflection densities, as compared with reference developers Nos. 15 to 19. Similar results were obtained when both materials were pulled apart 15 seconds after the delivery from the squeeze rollers.

EXAMPLE 3

The procedure of Example 2 was repeated, except that various test compounds shown in Table 3 were used. Since the test results showed tendencies similar to those in Example 2, only the reflection densities obtained by using each $3\times10^{-1}$ mmol/liter of the test compound and potassium iodide were shown in Table 3.

TABLE 3

| Developer No. | Compound No. | Reflection density |
|---|---|---|
| 24 | (2) | 1.53 |
| 25 | (6) | 1.53 |
| 26 | (8) | 1.51 |
| 27 | (10) | 1.52 |
| 28 | (12) | 1.52 |
| 29 | (13) | 1.49 |
| 30 | (16) | 1.53 |
| 31 | (17) | 1.52 |
| 32 | (18) | 1.51 |
| 33 | (19) | 1.53 |
| 34 | (22) | 1.47 |
| 35 | (23) | 1.51 |

The silver image obtained by using any of the present developers was purer in blackness than those obtained by using reference developer No. 15.

EXAMPLE 4

A positive material was prepared by incorporating compound No. 1 in the image receptive layer of the positive material of Example 2 in an amount of $1\times10^{-1}$ millimoles per square meter. Otherwise the procedure of Example 2 was repeated, except that the following transfer developer was used.

| Transfer developer: | |
|---|---|
| Water | 700 ml |
| Trisodium phosphate, dodecahydrate | 70 g |
| Potassium hydroxide | 10 g |
| Sodium sulfite, anhydrous | 50 g |
| Sodium thiosulfate, pentahydrate | 15 g |
| Diethylaminoethanol | 20 ml |
| Compound No. 1 | $3\times10^{-1}$ mmol |
| Potassium iodide | $2\times10^{-1}$ mmol |
| Potassium bromide | 0.5 g |
| Made up with water to | 1 liter |

There was obtained, as in Example 2, a transferred silver image of desirable tone and high density.

What is claimed is:

1. A silver complex diffusion transfer process which comprises the steps of:

(1) exposing a silver halide emulsion layer, (2) developing the emulsion layer with an alkaline solution in the presence of a silver halide developing agent and a silver halide solvent to form a diffusible silver complex, and then (3) transferring the diffusible silver complex onto an image receiving layer to form a silver image, wherein said alkaline solution contains an alkali-soluble iodide and a nitrogen-containing heterocyclic compound represented by the following general formula (I) or (II):

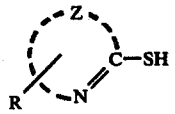

(I)

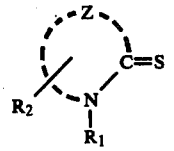

(II)

in which R represents an alkyl group of at least 4 carbon atoms, an aryl group or a group containing both the alkyl and aryl groups, $R_1$ and $R_2$ represent a hydrogen atom or a substituent and at least one of $R_1$ and $R_2$ represents an alkyl group of at least 4 carbon atoms, an aryl group or a group containing both the alkyl and aryl groups, and Z represents a 5- or 6-membered heterocyclic ring the iodine and the heterocyclic compound present in an amount such that the molar ratio of the iodide in terms of iodine to the heterocyclic compound is in the range of from 1:5 to 5:1.

2. A silver complex diffusion transfer process according to claim 1, wherein the molar ratio in the developer is in the range of from 1:3 to 3:1.

3. A silver complex diffusion transfer proces according to claim 1, wherein the total amount of the heterocyclic compound and the alkali-soluble iodide in the developer is in the range of from 0.01 to 1.5 millimoles per liter.

4. A silver complex diffusion transfer process according to claim 1 wherein the nitrogen-containing heterocyclic compound in the developer is

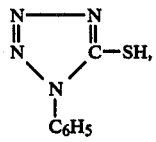

(1)

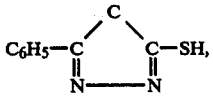

(2)

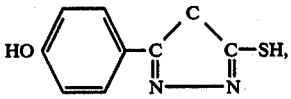

(3)

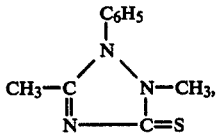

(4)

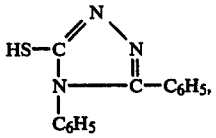

(5)

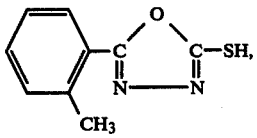

(6)

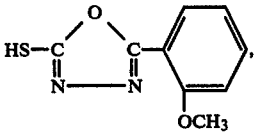

(7)

-continued (8)

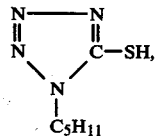

(9)

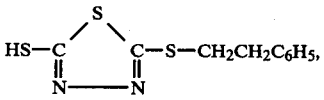

(10)

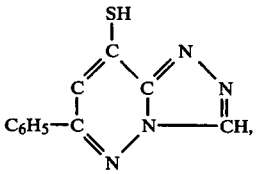

(11)

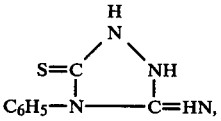

(12)

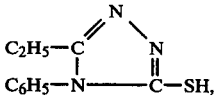

(13)

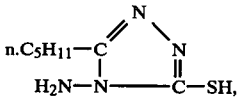

(14)

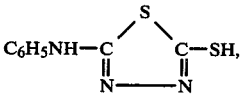

(15)

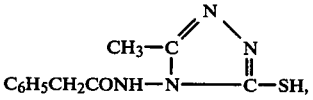

(16)

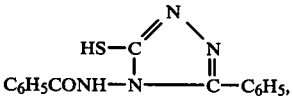

(17)

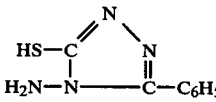

(18)

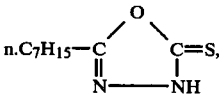

-continued (19)

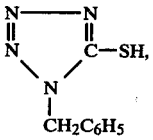

(20)

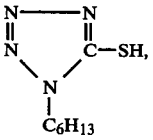

(21)

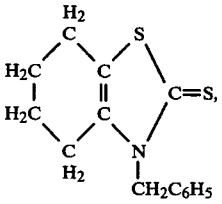

(22)

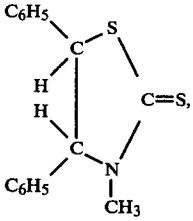

(23)

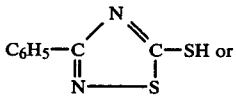

(24)

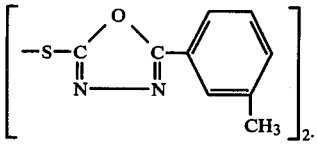

5. A silver acomplex diffusion transfer process according to claim 4 wherein the developer additionally contains alkaline substances, preservatives and silver halide solvents.

6. A silver complex diffusion transfer process according to claim 1 wherein the amount of the nitrogen-containing heterocyclic compound in the developer is 0.001 to 3.0 mmol/l.

7. A silver complex diffusion transfer process according to claim 1 wherein the amount of the iodide in the developer is 0.001 to 3.0 mmol/l in terms of iodine.

8. A silver complex diffusion transfer process according to claim 1 wherein the developer additionally contains a secondary or tertiary aminoalcohol substituted with alkyl group of 1 to 4 carbon atoms.

* * * * *